United States Patent [19]

Braun et al.

[11] 4,358,312

[45] Nov. 9, 1982

[54] DESULFURIZING AGENT AND PROCESS FOR ITS MANUFACTURE

[75] Inventors: Albert Braun, Hürth-Burbach; Willi Portz, Erftstadt-Kierdorf; Georg Strauss, Erftstadt-Lechenich; Hans-Martin Delhey, Duisburg, all of Fed. Rep. of Germany

[73] Assignee: Hoechst Aktiengesellschaft, Fed. Rep. of Germany

[21] Appl. No.: 218,731

[22] Filed: Dec. 22, 1980

[30] Foreign Application Priority Data

Dec. 29, 1979 [DE] Fed. Rep. of Germany ..... 2952761
Mar. 8, 1980 [DE] Fed. Rep. of Germany ..... 3008950

[51] Int. Cl.[3] ..... C21C 7/02
[52] U.S. Cl. ..... 75/58; 75/53
[58] Field of Search ..... 75/53, 58

[56] References Cited

U.S. PATENT DOCUMENTS

| | | | |
|---|---|---|---|
| 3,197,306 | 7/1965 | Osborn | 75/53 |
| 3,314,782 | 4/1967 | Arnaud | 75/53 |
| 3,333,954 | 8/1967 | Dawson | 75/53 |
| 3,598,573 | 8/1971 | Freissmuth | 75/58 |
| 3,716,352 | 2/1973 | Ooi | 75/58 |
| 4,036,635 | 7/1977 | Klapdar | 75/58 |

FOREIGN PATENT DOCUMENTS

| | | | |
|---|---|---|---|
| 52-61112 | 5/1977 | Japan | 75/58 |
| 54-155918 | 8/1979 | Japan | 75/58 |

*Primary Examiner*—P. D. Rosenberg
*Attorney, Agent, or Firm*—Connolly and Hutz

[57] ABSTRACT

The invention relates to agents for the desulfurization of metal melts, especially of steel and crude iron melts, based on mixtures of $CaC_2/CaO$ crystals produced in the fused mass. A portion of the CaO in the crystal mixture is hydrated to form $Ca(OH)_2$. A process for the manufacture of these agents is also described.

14 Claims, No Drawings

DESULFURIZING AGENT AND PROCESS FOR ITS MANUFACTURE

The invention relates to an agent for the desulfurization of metal melts, especially of steel and crude iron melts, based on mixtures of $CaC_2/CaO$ crystals produced in the fused mass, and to a process for the manufacture of the agent.

Desulfurizing agents based on $CaC_2/CaO$ and those which may additionally contain fluorspar have already been described (German Patent Specification No. 20 37 758). Furthermore, it is known art that metal melts can be desulfurized with commercial carbide (approximately 80% by weight of $CaC_2$ and the remainder CaO), or alternatively with mixtures of such carbide with additives such as lime, coke or gas-yielding materials, for example $CaCO_3$, $CaCN_2$ or $Ca(OH)_2$ (German Auslegeschrift No. 22 52 795). In order to enable effective use to be made of the desulfurizing agents described heretofore, it has been necessary for them to be ground as finely as possible, especially for use in a submerged lance process. Although these agents then fulfil the demands made of them, they are expensive both to manufacture and to use, and it is still necessary, even for such finely ground desulfurizing agents, to be used in relatively large quantities in order to achieve the desired degree of desulfurization.

It is therefore the object of the present invention to provide an improved more efficient desulfurizing agent and a process for making it under commercially attractive conditions.

To this end, the invention provides for a portion of the CaO in the crystal mixture to be hydrated to form $Ca(OH)_2$. It is preferable to use as starting material crystal mixtures containing 40 to 80% by weight of CaO (corresponding to 20 to 60% by weight of $CaC_2$), especially 45 to 80% by weight of CaO (corresponding to 20 to 55% by weight of $CaC_2$), or 40 to 65% by weight of CaO (corresponding to 35 to 60% by weight of $CaC_2$). A preferred feature of the present invention provides for the CaO in the crystal mixture to be hydrated with 1 to 6% by weight of $H_2O$, preferably 2.5 to 3.5% by weight of $H_2O$, based on the quantity of $CaC_2/CaO$. On solidifying, CaO and $CaC_2$ crystallize out of the fused mass in the form of a crystal mixture in which the $CaC_2$ and CaO crystals have grown into one another; in the event of $CaC_2$ and CaO being used in the quantitative ratio specified, the mixture has a composition lying in the region of the eutectic or has a subeutectic composition displaced towards the lime side. On the addition of $H_2O$ a portion of the CaO in the crystal mixture reacts according to the equation $$CaO + H_2O \rightarrow Ca(OH)_2$$

without the $CaC_2$ that has grown into the CaO crystals being significantly attacked by the $H_2O$.

Upon the introduction of such desulfurizing agent into a metal melt, the ground particles thereof, consisting of $CaO/CaC_2$ crystal intergrowths in which a portion of the CaO crystals is hydrated, are found to decompose at temperatures of above 800° C. according to the following reaction equation:

$$CaC_2 + Ca(OH)_2 \rightarrow 2CaO + 2C + H_2$$

As a result of the evolution of gas at the reactive interfaces of the crystals, the ground particles disintegrate regularly, liberating lime highly-reactive in statu nascendi and increasing the surface area of the $CaO/CaC_2$ intergrowth crystals. The almost eutectic crystal structure results in a reaction surface area of ideal size. The liberated gases, which have a reducing action, provide ideal conditions for reacting the CaO with the sulfur dissolved in the metal melt.

A desulfurizing agent of this type is extremely well suited for desulfurization processes in which there is a very limited time available for the reaction of the desulfurizing agent with the sulfur. Among these processes is the submerged lance process in which, by blowing desulfurizing agents into a metal melt below the surface of the melt, the reaction of the desulfurizing agent should take place as completely as possible in the short time between the desulfurizing agent being discharged into the melt and its rising to the surface of the bath.

The desulfurizing efficiency of the desulfurizing agent according to the invention compares favorably with that of the best known carbide-based agents. As a result of the inter-crystalline gas reaction in the ground particles, the reaction of $CaC_2$ to form CaO and the resulting increase in the size of the crystals' surface area is more effective, the evolution of gas is more uniform and less violent than in the case of known desulfurizing agents, for example such as those described in German Auslegeschrift No. 22 52 795, which have gas-yielding additives mechanically intermixed therewith. The desulfurization therefore takes place more smoothly and with less metal ejection, especially in the open ladle and the torpedo ladle. As a result of the higher reactivity of the desulfurizing agent according to the invention, which originates from the increase the crystal surface areas undergo upon the disintegration of the ground particles in the melt, it is possible to use the present agent in the form of relatively coarse particles, which need not be subjected to expensive fine grinding treatment.

As a result of the relatively homogeneous composition of the desulfurizing agent of this invention it is possible with greater reliability to establish the end content desired in each particular case. In addition to this, the present agent can be produced with considerably lower expense than known carbide-based agents.

The invention also provides a process for the manufacture of the present agent, which comprises: adding $H_2O$ to a $CaC_2/CaO$ crystal mixture while grinding it, the crystal mixture being used in the form of lumpy material, or partially hydrating CaO in the finished ground particles.

A particularly advantageous feature of the present process for making a final product containing 20 to 55% by weight of calcium carbide, more than 45 up to 80% by weight of calcium oxide and water chemically combined with calcium oxide, provides for finely divided calcium oxide to be introduced in an excess of from 3 to 15% by weight, based on the quantity desired in the final product, into a customary previously prepared calcium carbide melt which already has up to 45% by weight of calcium oxide therein; for the resulting mixture to be then cooled to temperatures of 350° to 450° C. to cause solidification; for the solidified mixture to be rough-crushed at these temperatures to particles with a size of less than 150 mm; for invariably obtained particles with a size smaller than 4 mm to be separated from coarser material; and for the latter to be comminuted in the presence of air or nitrogen with a moisture content of 5 to 20 g/m$^3$ (at 1.013 bar and 273.15K) by breaking and grinding at temperatures lower than 100° C., preferably at 10° to 50° C., to produce particles with a size of less than 10 mm, preferably less than 0.1 mm.

Further preferred features of the present process provide:

(a) for the final product to contain 1 to 6% by weight of water which is chemically combined with calcium oxide;

(b) for the carbide to be rendered lean by admixing it with the calcium oxide in a crucible with utilisation of the heat content of the carbide;

(c) for the calcium oxide which is added to the calcium carbide melt to be pre-heated to temperatures of up to 2000° C. and for it to be introduced into the melt while hot, the calcium oxide being pre-heated to temperatures which are the higher, the higher the proportion of additionally dissolved calcium oxide within the range 45 to 80% by weight;

(d) for a calcium carbide melt containing between 20 and 45% by weight of calcium oxide to be used as starting material; and (e) for the fraction of particles with a size smaller than 4 mm, sieved off after the rough crushing step, to be recycled into the process.

In those cases in which the calcium oxide that is added to the melt is previously pre-heated to temperatures of up to 2000° C., preferably of up to 1100° C., and, at these temperatures, is introduced into the melt while hot, it is possible to increase the CaO content in the carbide to up to 80% by weight, the calcium oxide being pre-heated to temperatures which are the higher, the higher the proportion of additionally dissolved calcium oxide within the range 45 to 80% by weight. As a result, use can be made of the desulfurizing agent in low-carbon crude iron and steel melts and the desulfurization yield, based on calcium carbide, is increased.

The fraction of particles with a size smaller than 4 mm, which is sieved off after the rough crushing step, consists substantially of CaO. This finely divided calcium oxide should be recycled into the process and used together with fresh CaO as starting material therein. Needless to say, the artisan would not have expected the step of sieving off the fraction of particles with a size smaller than 4 mm, which are formed after the rough crushing, and which have no or only a slight desulfurization efficiency, would result in the efficiency of the final product being so considerably increased.

The product made in accordance with this invention is considerably easier to grind than products obtained by prior processes. This is of special importance inasmuch as the product is sometimes required to be used in the form of particles with a size of less than 0.1 mm.

The following Examples illustrate the invention:

EXAMPLE 1

Calcium carbide was made from lime and coke in customary manner, for example electrothermally, the lime/coke mixture in the charge being set at a ratio by weight of 100:40, corresponding to a carbide having a CaO content of approximately 40% by weight. CaO with a particle size of from 3 to 8 mm and a $Ca(OH)_2$ and $CaCO_3$ content of less than 1% by weight, respectively, was added to a stream of molten carbide drawn off the furnace into a crucible at such a rate and in such quantities that by the time the crucible was full the total ratio by weight $CaC_2$:CaO was 43:57, corresponding to an excess of 14% by weight of CaO, based on the CaO content of 50% by weight desired for the final product. Next, the product was cooled out until the average temperature of the solidified carbide block was approximately 400° C., and the block was rough-crushed to material of less than 150 mm in size.

The fraction of particles smaller than 4 mm, which were formed during rough crushing, contained substantially the CaO in excess, while the remaining product consisting of particles with a size of more than 4 mm was a crystal mixture of 50% by weight of $CaC_2$ and 50% by weight of CaO. It was ground at 50° C. in a rotary mill with a throughput of 500 kg/h, while passing through 1500 m$^3$/h of air with a moisture content of 10 g/m$^3$ (at 15° C.), to produce particle size of less than 0.1 mm. The particle fraction smaller than 4 mm was sieved off and, together with fresh lime (CaO), it was re-used as starting material. The resulting product contained 2.5% by weight of chemically combined water.

1500 kg of this product was blown into a 300 t crude iron melt having a sulfur content of 0.03% by weight at a temperature of 1400° C., and the sulfur content of the iron melt was reduced to less than 0.005% by weight.

EXAMPLE 2

The procedure was as in Example 1 except that the CaO was pre-heated to a temperature of approximately 1100° C. prior to introducing it into the melt, and the quantity of CaO was increased to such an extent that the total CaO content in the crucible was 62.5% by weight, corresponding to an excess of 4% by weight, based on the CaO content of 60% by weight desired for the final product.

1800 kg of the product, worked up and ground according to the invention, were used for the desulfurization of a 300 t steel melt having a sulfur content of 0.02% by weight at 1650° C. The sulfur content of the melt was reduced to less than 0.005% by weight.

EXAMPLE 3

(a) A 300 t crude iron melt having the following analysis (% by weight):

4.5% carbon, 0.8% silicon, 0.7% manganese, 0.08% phosphorus, 0.064% sulfur and the balance iron, was desulfurized according to the submerged lance process in an open ladle with the use of a desulfurizing agent according to the invention consisting of 50% by weight of $CaC_2$ and 50% by weight of CaO hydrated with approximately 3% by weight of $H_2O$. The submersion depth of the lance was 1.8 m. The blowing-in speed was 100 kg/min. The total consumption of desulfurizing agent was 4.5 kg/t, by means of which the sulfur content was reduced to 0.009% by weight. This corresponds to a degree of desulfurization of 86%.

(b) In a comparative test, use was made of a prior mixture consisting of 85% by weight of commercial carbide ($CaC_2$ content 78% by weight) and 15% by weight of $CaCO_3$. For the submersion depth and blowing-in speed as in Example 3a), 6.0 kg/t were required to achieve the same degree of desulfurization with the same initial sulfur content.

As compared with the prior desulfurizing agent used in this comparative test the desulfurizing agent according to the invention permitted a 25% economy, based on the absolute quantity of desulfurizing agent, and a 45% economy, based on the $CaC_2$ content, to be achieved. The treatment time was also reduced at the same rate.

We claim:

1. An agent for the desulfurization of steel and crude iron melts, said agent containing crystals crystallized out of a fused mass comprising CaO and $CaC_2$ and comprising 40–80% by weight of CaO and 1–6% by weight of chemically combined water, which water has hydrated said CaO to form $Ca(OH)_2$.

2. An agent for the desulfurization of steel and crude iron melts comprising a $CaC_2$/CaO crystalline mixture crystallized out of a fused mass comprising CaO and $CaC_2$, 40–80% by weight of said crystalline mixture comprising CaO and 1–6% by weight of said crystalline mixture comprising $H_2O$ as chemically combined water which has hydrated said CaO to form $Ca(OH)_2$.

3. The agent as claimed in claim 1, wherein a crystal mixture having a CaO content of 45 to 80% by weight is used as starting material.

4. The agent as claimed in claim 1, wherein a crystal mixture having a CaO content of 40 to 65% by weight is used as starting material.

5. A process for the manufacture of an agent as claimed in claim 1, wherein $H_2O$ is added to a lumpy $CaC_2$/CaO crystal mixture, while grinding it, or CaO is partially hydrated in the finished ground particles.

6. The process as claimed in claim 5, wherein finely divided calcium oxide is introduced in an excess of 3 to 15% by weight, based on the quantity desired in the final product, into a customary previously prepared calcium carbide melt which already has up to 45% by weight of calcium oxide therein, the resulting mixture is then cooled to temperatures of 350° to 450° C. to cause solidification, the solidified mixture is rough-crushed at these temperatures to particles with a size of less than 150 mm; invariably obtained particles with a size smaller than 4 mm are separated from coarser material and the latter is comminuted in the presence of air or nitrogen with a moisture content of 5 to 20 g/m$^3$ (at 1.013 bar and 273.15K) by crushing and grinding at temperatures lower than 100° C. to particles with a size of less than 10 mm, with the resultant formation of a final product containing 20 to 55% by weight of calcium carbide, more than 45 up to 80% by weight of calcium oxide, and also water chemically combined with calcium oxide.

7. The process as claimed in claim 6, wherein the calcium oxide is added inside a crucible.

8. The process as claimed in claim 6, wherein the calcium oxide added to the calcium carbide melt is pre-heated to temperatures of up to 2000° C. and is introduced into the melt while hot, the calcium oxide being pre-heated to temperatures which are the higher, the higher the proportion of additionally dissolved calcium oxide desired within the range 45 to 80% by weight.

9. The process as claimed in claim 6, wherein a calcium carbide melt containing 20 to 45% by weight of calcium oxide is used as starting material.

10. The process as claimed in claim 6, wherein the fraction of particles with a size smaller than 4 mm sieved off after the rough crushing step, is recycled into the process.

11. The process as claimed in claim 6, wherein remaining product is comminuted in the presence of air or nitrogen with a moisture content of 5 to 20 g/m$^3$ (at 1.013 bar and 273.15K) by crushing and grinding at temperatures of 10° to 50° C. to particles with a size of less than 10 mm.

12. The process as claimed in claim 6, wherein the remaining product is comminuted to particles with a size of less than 0.1 mm.

13. The agent as claimed in claim 1, having been made by adding finely divided calcium oxide in an excess of 3 to 15% by weight, based on the quantity of CaO desired for the final product of more than 45 up to 80% by weight, into a previously prepared calcium carbide melt containing up to 45% by weight of calcium oxide, then cooling the resulting mixture to temperatures of 350° to 450° C., to cause solidification, rough-crushing the solidified mixture at these temperatures to particles with a size of less than 150 mm, separating an invariably obtained fraction of particles with a size smaller than 4 mm, from the remaining product and comminuting the latter in the presence of air or nitrogen with a moisture content of 5 to 20 g/m$^3$ (at 1.013 bar and 273.15K) by crushing and grinding at temperatures of less than 100° C. to particles with a size of less than 10 mm.

14. The Agent according to claim 13, containing 1 to 6% by weight of water chemically combined with calcium oxide.

* * * * *